US007540154B2

(12) United States Patent
Tanimura et al.

(10) Patent No.: US 7,540,154 B2
(45) Date of Patent: Jun. 2, 2009

(54) GAS TURBINE COMBUSTOR

(75) Inventors: Satoshi Tanimura, Takasago (JP); H. Lindsay Morton, Miami, FL (US); Robert D. Zangara, Lake Mary, FL (US)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 594 days.

(21) Appl. No.: 11/201,276

(22) Filed: Aug. 11, 2005

(65) Prior Publication Data

US 2007/0033919 A1 Feb. 15, 2007

(51) Int. Cl.
*F02C 3/00* (2006.01)
*F23R 3/36* (2006.01)

(52) U.S. Cl. ..... 60/742; 60/747; 60/748

(58) Field of Classification Search ..... 60/742, 60/746, 747, 748, 39.463
See application file for complete search history.

(56) References Cited

U.S. PATENT DOCUMENTS

| | | | | |
|---|---|---|---|---|
| 4,216,652 | A * | 8/1980 | Herman et al. | 60/748 |
| 4,425,755 | A * | 1/1984 | Hughes | 60/742 |
| 5,185,997 | A * | 2/1993 | Nishijima | 60/740 |
| 5,423,173 | A * | 6/1995 | Lemon et al. | 60/742 |
| 5,481,866 | A * | 1/1996 | Mowill | 60/737 |
| 5,505,045 | A * | 4/1996 | Lee et al. | 60/742 |
| 6,655,145 | B2 * | 12/2003 | Boardman | 60/742 |
| 2004/0255589 | A1 * | 12/2004 | Yoshida et al. | 60/746 |

FOREIGN PATENT DOCUMENTS

| | | | |
|---|---|---|---|
| EP | 0 286 569 | A2 | 10/1988 |
| JP | 08-005076 | | 1/1996 |
| JP | 08-145363 | | 6/1996 |
| JP | 09-264536 | | 10/1997 |
| JP | 2000-130756 | A | 5/2000 |

OTHER PUBLICATIONS

Office Action issued Sep. 5, 2008 in Corresponding Chinese Patent Application No. 200610005944.3.

* cited by examiner

*Primary Examiner*—Ted Kim
(74) *Attorney, Agent, or Firm*—Westerman, Hattori, Daniels & Adrian, LLP.

(57) ABSTRACT

This invention aims to suppress the occurrence of smoke, for example, during a light load operation of a gas turbine, by adopting an air blast method for a pilot nozzle in a dual fuel combustion low $NO_x$ combustor. A gas turbine combustor of the present invention is that in a gas turbine furnished with a dual fuel combustion low $NO_x$ combustor having a pilot nozzle capable of injecting a gaseous fuel and a liquid fuel simultaneously or selectively, and a plurality of main nozzles disposed around the pilot nozzle and being capable of injecting a gaseous fuel and a liquid fuel simultaneously or selectively, wherein the pilot nozzle has a gas nozzle portion for injecting the gaseous fuel, and a liquid nozzle portion for injecting the liquid fuel, adopts an air blast method for the liquid nozzle portion, uses combustion air as air for an air blast, and throws the combustion air at a liquid film formed in the liquid nozzle portion to atomize the liquid fuel by use of a velocity difference.

4 Claims, 5 Drawing Sheets

GAS TURBINE COMBUSTOR

BACKGROUND OF THE INVENTION

1. Field of the Invention

This invention relates to a dual fuel combustion low $NO_x$ combustor of a gas turbine.

2. Description of the Related Art

In recent years, various improvements have been made on a combustor, etc. in a gas turbine to decrease $NO_x$ and raise the temperature of the gas turbine (raise the inlet temperature of the turbine), thereby achieving a high efficiency.

As shown in FIG. 4, for example, a fuel F, which has been injected through a pilot nozzle 102 provided at the center of a combustor inner tube 101, and a plurality of main nozzles 103 provided around the pilot nozzle 102, and compressed air PA, which has been discharged from a compressor 104 and introduced to an upstream side of the combustor inner tube 101, are mixed in a combustor 100 of a gas turbine. Then, the mixture is combusted in a combustion zone on a downstream side of the combustor inner tube 101 or an upstream side of a combustor transition pipe 105, and is introduced as a high temperature, high pressure combustion gas CG into the turbine equipped with stationary blades 106 and moving blades 107. In the turbine, the combustion gas CG is expanded to serve as a driving force, which drives the compressor 104 and outputs a surplus driving force to the outside.

The ratio between the compressed air PA and the fuel F introduced into the combustor inner tube 101 (i.e., fuel-air ratio) needs to be controlled to take an optimal value according to the operating state of the gas turbine (namely, the amount of fuel charged). For this purpose, not all of the compressed air PA is introduced into a combustion section of the combustor 100, but part of the compressed air PA is bypassed and flowed from a turbine casing 108 into the combustor transition pipe 105. A bypass valve 109 is provided for this purpose, and allows part of the compressed air PA to be flowed and supplied into the combustor transition pipe 105 from an opening portion of a bypass pipe 110 provided in the turbine casing 108.

In such a combustor 100, the upstream side of the combustor inner tube 101 is allocated as a first stage combustion zone, and the downstream side of the combustor inner tube 101 is allocated as a second stage combustion zone. A relatively small amount of fuel is injected through the pilot nozzle 102 into the first stage combustion zone to generate a high temperature combustion gas. With this combustion gas as a flame (trigger), a large amount of a lean premixed fuel mixture is injected through the main nozzles 103 into the second stage combustion zone, whereby the generation of a locally high temperature combustion gas is prevented, and $NO_x$ is kept to a minimum (see, for example, Japanese Patent Application Laid-Open No. 2000-130756).

As the combustor 100 mentioned above, a so-called dual fuel combustion low $NO_x$ combustor is known which has the pilot nozzle 102 capable of injecting a gaseous fuel and a liquid fuel simultaneously or selectively, and the plurality of main nozzles 103 disposed around the pilot nozzle 102 and being capable of injecting a gaseous fuel and a liquid fuel simultaneously or selectively.

The pilot nozzle 102 is taken as an example for illustration, as shown, for example, in FIG. 5. The pilot nozzle 102 has a liquid nozzle portion 112 of a pressure spraying type, provided at the center of a nozzle body 111, for spraying a liquid fuel, and a plurality of gas nozzle portions 113, concentrically surrounding the liquid nozzle portion 112, for injecting a gaseous fuel obliquely outwardly.

In such a dual fuel combustion low $NO_x$ combustor, the pilot nozzle 102 renders varieties of fuels available, and can use different fuels in combination, thereby actualizing diffusive combustion with excellent stability of combustion, while the main nozzles 103 can use many fuels, thereby making it possible to decrease the amount of a pilot fuel used in diffusive combustion, and achieve pre-mixed combustion involving a minimal $NO_x$ concentration (see, for example, Japanese Patent Application Laid-Open No. 1997-264536).

In the above-described dual fuel combustion low $NO_x$ combustor, however, a pressure spraying type nozzle is used as the liquid nozzle portion 112 for injecting a liquid fuel in the pilot nozzle 102. This has posed the problem that if an operation with a high pilot ratio (a high ratio of the amount of the liquid fuel injected from the pilot nozzle 102 to the amount of the liquid fuel injected from the main nozzles 103) is performed to ensure combustion stability, for example, during a light load operation of the gas turbine, smoke (black smoke) occurs, causing pollution.

SUMMARY OF THE INVENTION

An object of the present invention is to suppress the generation of smoke, for example, during a light load operation of the gas turbine, by adopting an air blast method for the pilot nozzle in the dual fuel combustion low $NO_x$ combustor.

To attain the above object, the gas turbine combustor of the present invention is a gas turbine combustor in a gas turbine furnished with a dual fuel combustion low $NO_x$ combustor having a pilot nozzle capable of injecting a gaseous fuel and a liquid fuel simultaneously or selectively, and a plurality of main nozzles disposed around the pilot nozzle and being capable of injecting a gaseous fuel and a liquid fuel simultaneously or selectively, wherein the pilot nozzle has a gas nozzle portion for injecting the gaseous fuel, and a liquid nozzle portion for injecting the liquid fuel, adopts an air blast method for the liquid nozzle portion, uses combustion air as air for an air blast, and throws the combustion air at a liquid film formed in the liquid nozzle portion to atomize the liquid fuel by use of a velocity difference between the combustion air and the liquid film.

The gas turbine combustor is characterized in that the liquid nozzle portion is formed in an annular shape in order to inject the liquid fuel in an annular liquid film state, and further has a first air blast nozzle portion for producing an air blast along an inner surface of a film of the liquid fuel injected in the annular liquid film state, and a second air blast nozzle portion for producing an air blast along an outer surface of the film of the liquid fuel.

The gas turbine combustor is also characterized in that an air passage for supplying the combustion air at least to the first air blast nozzle portion is branched into a plurality of sections in a circumferential direction of the pilot nozzle, a gas passage for supplying the gaseous fuel to the gas nozzle portion, and a liquid passage for supplying the liquid fuel to the liquid nozzle portion are each similarly branched into a plurality of sections in the circumferential direction of the pilot nozzle, and the plural sections of the air passage and the plural sections of the gas passage and/or the plural sections of the liquid passage are alternately disposed in the circumferential direction of the pilot nozzle.

The gas turbine combustor is also characterized in that the air passage is disposed at an angle with respect to a radial line of the pilot nozzle in order to generate a swirl in the first air blast nozzle portion.

The gas turbine combustor is also characterized in that the second air blast nozzle portion is formed in an annular shape for producing the air blast in an annular form.

The gas turbine combustor is also characterized in that the second air blast nozzle portion has a swirler disposed in an interior thereof.

The gas turbine combustor is also characterized in that the liquid nozzle portion is provided inside a swirler which is disposed inside an air blast nozzle portion formed in an annular shape for producing the air blast in an annular form.

The gas turbine combustor is also characterized in that the liquid nozzle portion is oriented such that the liquid fuel is injected along an exterior of the air blast produced in an air blast nozzle portion.

The gas turbine combustor is also characterized in that an air passage for supplying the combustion air to the air blast nozzle portion is branched into a plurality of sections in a circumferential direction of the pilot nozzle, a gas passage for supplying the gaseous fuel to the gas nozzle portion is similarly branched into a plurality of sections in the circumferential direction of the pilot nozzle, and the plural sections of the air passage and the plural sections of the gas passage are alternately disposed in the circumferential direction of the pilot nozzle.

The gas turbine combustor is also characterized in that the first air blast nozzle portion is provided at a center of the pilot nozzle, and the combustion air within a turbine casing is supplied to the first air blast nozzle portion via external piping through an air passage penetrating a nearly central portion of the pilot nozzle.

The gas turbine combustor is also characterized in that the first air blast nozzle portion has a swirler disposed in an interior thereof.

DESCRIPTION OF THE PREFERRED EMBODIMENTS

The gas turbine combustor according to the present invention will now be described in detail by embodiments with reference to the accompanying drawings.

Embodiment 1

Figure 1:
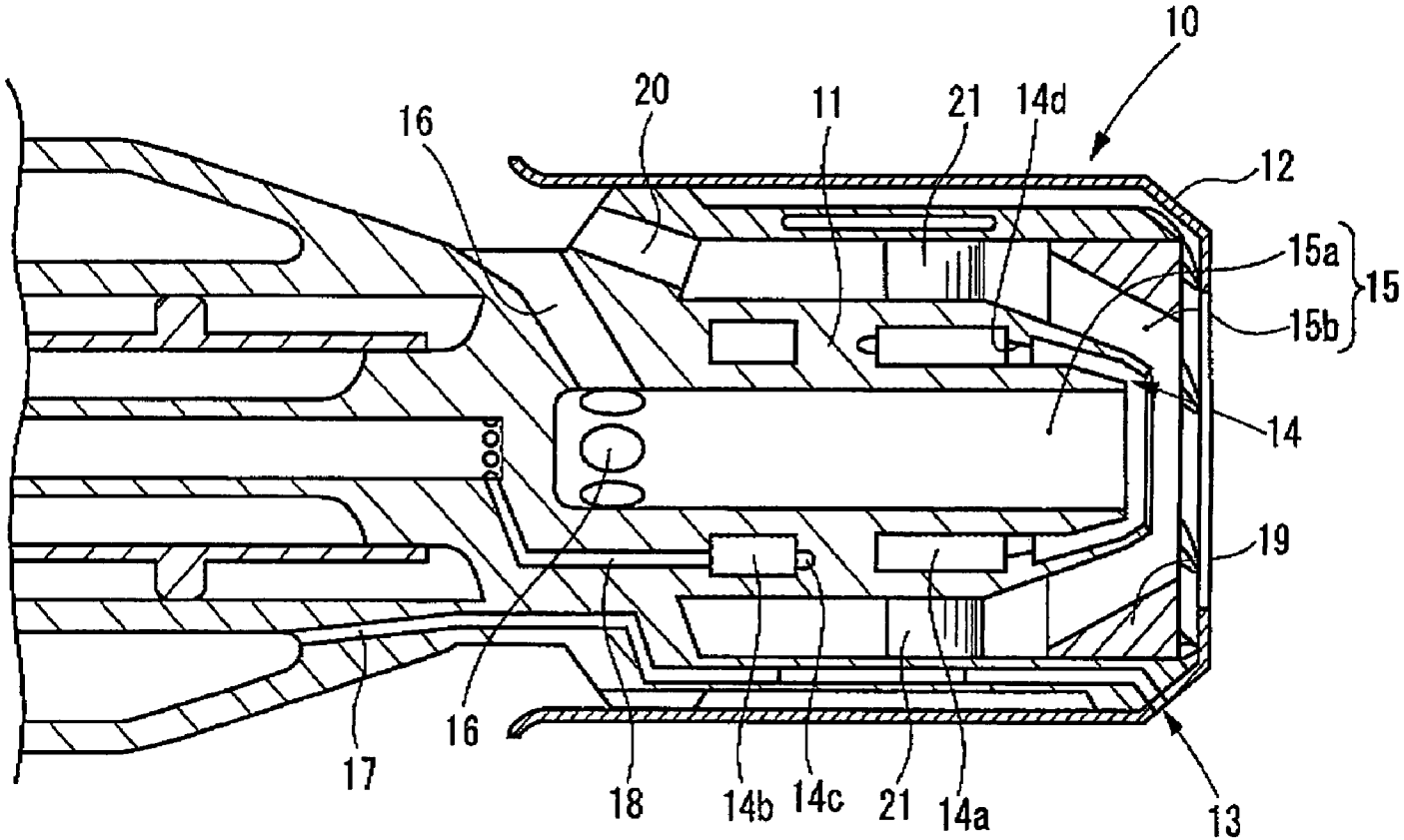
FIG. 1 is a sectional view of essential parts of a pilot nozzle, showing Embodiment 1 of the present invention.

FIG. 1 is a sectional view of essential parts of a pilot nozzle, showing Embodiment 1 of the present invention.

As shown in FIG. 1, a pilot nozzle 10 of a dual fuel combustion low $NO_x$ combustor in a gas turbine comprises a rod-shaped nozzle body 11 fitted into a tubular nozzle cover 12.

The nozzle body 11 has a gas nozzle portion 13 for injecting a gaseous fuel such as LNG, and a liquid nozzle portion 14 for injecting a liquid fuel such as a light oil or kerosene. An air blast method is adopted for the liquid nozzle portion 14, and combustion air (pressurized air) is used as air for an air blast. The combustion air is thrown at a liquid film formed in the liquid nozzle portion 14 so that the liquid fuel is atomized by use of a velocity difference between the combustion air and the liquid film (a shearing force works).

A plurality of the gas nozzle portions 13 are provided in an outer peripheral portion of the tip of the nozzle body 11 in such a manner as to pass through the nozzle cover 12, and are adapted to inject the gaseous fuel obliquely outwardly of the nozzle body 11.

The liquid nozzle portion 14 has a front side formed in a tapered annular shape for injecting the liquid fuel in an annular liquid film state, and further has a first air blast nozzle portion 15*a* for producing an air blast (a stream of violently blown air) along the inner surface of the film of the liquid fuel injected in the annular liquid film state, and a second air blast nozzle portion 15*b* for producing an air blast along the outer surface of the film of the liquid fuel.

The first air blast nozzle portion 15*a* is formed as a horizontally elongated cavity at the center of the nozzle body 11. An air passage 16 for supplying pressurized air to the first air blast nozzle portion 15*a* is branched into a plurality of sections in the circumferential direction of the nozzle body 11. Similarly, a gas passage 17 for supplying the gaseous fuel to the gas nozzle portions 13, and a liquid passage 18 for supplying the liquid fuel to the liquid nozzle portion 14 are each branched into a plurality of sections in the circumferential direction of the nozzle body 11. The plural sections of the air passage 16 and the plural sections of the gas passage 17 and/or the plural sections of the liquid passage 18 are alternately disposed in the circumferential direction of the nozzle body 11. Moreover, the air passage 16 has an introduction end portion open to the outer periphery of an intermediate portion of the nozzle body 11, and is disposed at an angle with respect to the radial line of the nozzle body 11 in order to generate a swirl in the first air blast nozzle portion 15*a*.

The second air blast nozzle portion 15*b* has a front side formed in a tapered annular shape for producing an air blast in a tapered annular form. The numeral 19 in the drawing denotes a nozzle cap fitted over the front end of the nozzle body 11, and the nozzle cap 19 has an inner surface formed as a taper surface. An air passage (air introduction hole) 20 for supplying pressurized air to the second air blast nozzle portion 15*b* is branched into a plurality of sections in an outer peripheral portion of the nozzle body 11, and has an introduction-side end portion open to the outer periphery of an intermediate portion of the nozzle body 11. The second air blast nozzle portion 15*b* has a straight part, inside which a plurality of vane-shaped swirlers 21 are disposed in the circumferential direction.

The liquid nozzle portion 14 is divided into a front-stage liquid nozzle portion 14*a* having a first-half part formed in a tapered annular shape, and a rear-stage liquid nozzle portion 14*b* formed in a straight annular shape. The front-stage liquid nozzle portion 14*a* and the rear-stage liquid nozzle portion 14*b* are brought into communication by a plurality of swirl ports 14*c* provided in the circumferential direction of the nozzle body 11. Inside the front-stage liquid nozzle portion 14*a*, a step 14*d* for generating a swirl is formed in the shape of a rib.

Figure 4:
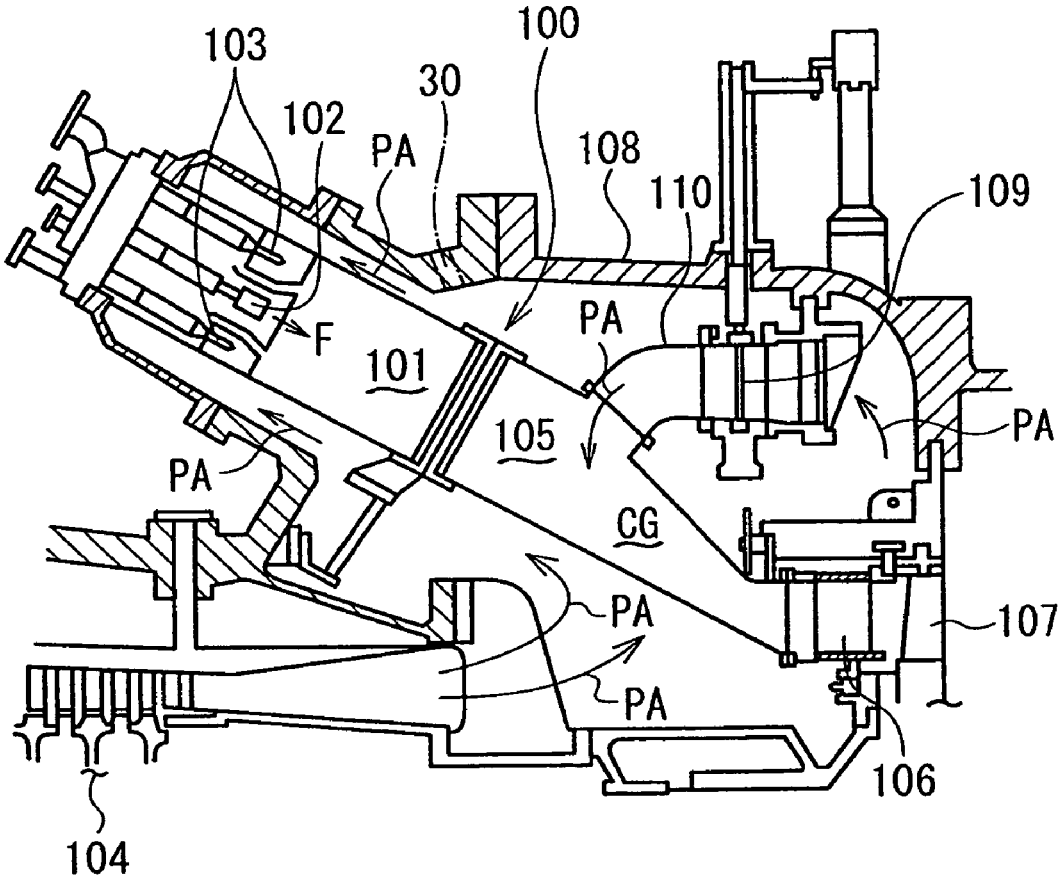
Fig. 4 Prior Art
FIG. 4 is a sectional view of the surroundings of a conventional gas turbine combustor.
Figure 5:
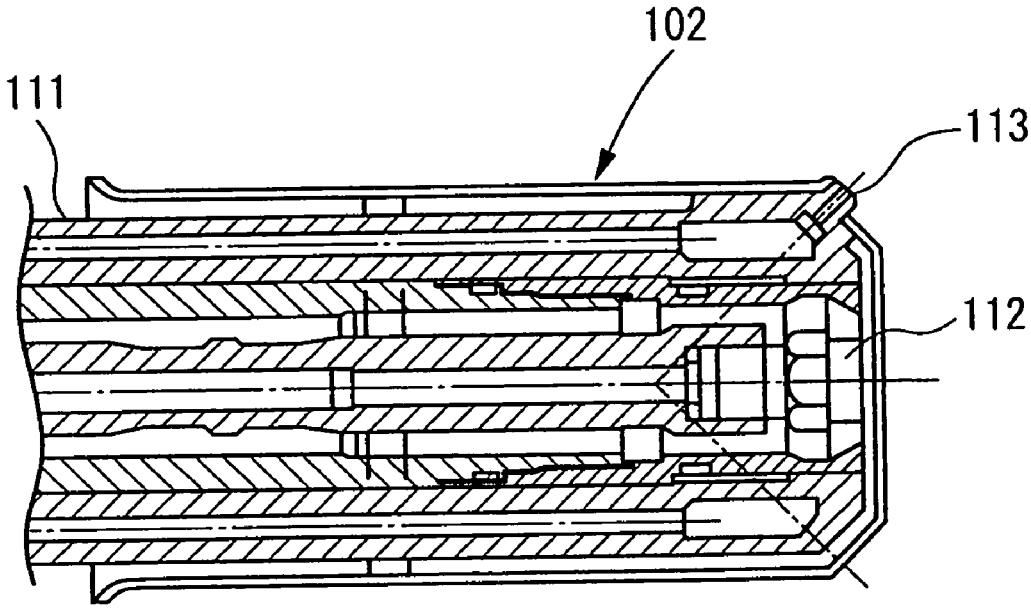
Fig. 5 Prior Art
FIG. 5 is a sectional view of essential parts of a conventional pilot nozzle.

Other features of the dual fuel combustion low $NO_x$ combustor are the same as those in FIG. 4, and duplicate explanations are omitted by reference to FIG. 4.

Because of the above configuration, if a gaseous fuel is used as the fuel for the dual fuel combustion low $NO_x$ combustor during the operation of the gas turbine, in the pilot nozzle 10, the gaseous fuel from a gaseous fuel supply source (not shown) passes through the gas passage 17 branched into plural sections in the circumferential direction of the nozzle body 11, and is injected obliquely outwardly from the gas nozzle portions 13 provided at the front ends of the plural sections.

If a liquid fuel is used simultaneously with, or selectively instead of, the gaseous fuel, the liquid fuel from a liquid fuel supply source (not shown) passes through the liquid passage 18 branched into plural sections in the circumferential direction of the nozzle body 11, and is supplied to the liquid nozzle portion 14 formed in an annular shape. From there, the liquid fuel is fed and, while being swirled by the swirl port 14*c* and the step 14*d*, is injected in an annular liquid film state from the tapered annular part of the front-stage liquid nozzle portion 14*a*.

At the same time, pressurized air from a pressurized air supply source (not shown; air discharged from the compressor of the gas turbine) is supplied to the first air blast nozzle portion 15*a* after passing through the air passage 16 branched into plural sections in the circumferential direction of the nozzle body 11, and is likewise supplied to the second air blast nozzle portion 15*b* past the air passage 20. The pressurized air supplied to the first air blast nozzle portion 15*a* is injected to the outside while being swirled because of the inclination of the air passage 16, thereby forming an air blast running along the inner surface of the film of the liquid fuel injected in an annular liquid film state from the liquid nozzle portion 14. The pressurized air supplied to the second air blast nozzle portion 15*b* is injected to the outside while being swirled by the swirlers 21, thereby forming an air blast running along the outer surface of the film of the liquid fuel injected in an annular liquid film state from the liquid nozzle portion 14.

As shown above, air blasts are formed along the inner and outer surfaces of the film of the liquid fuel injected in an annular liquid film state from the liquid nozzle portion 14. Thus, the atomization and evaporation of the liquid fuel are promoted to obtain a satisfactory state of combustion. Thus, even if an operation at a high pilot ratio is performed to ensure combustion stability, for example, during a light load operation of the gas turbine, the occurrence of smoke (black smoke) can be kept down.

In the present embodiment, the air passage 16, which supplies pressurized air to the first air blast nozzle portion 15*a* formed as a horizontally elongated cavity at the center of the nozzle body 11, is branched into a plurality of sections in the circumferential direction of the nozzle body 11. Similarly, the gas passage 17 for supplying the gaseous fuel to the gas nozzle portion 13, and the liquid passage 18 for supplying the liquid fuel to the liquid nozzle portion 14 are each branched into a plurality of sections in the circumferential direction of the nozzle body 11. The plural sections of the air passage 16 and the plural sections of the gas passage 17 and/or the plural sections of the liquid passage 18 are alternately disposed in the circumferential direction of the nozzle body 11. Thus, the complicatedness of the passage structure in the nozzle body 11 can be effectively avoided. In other words, the pilot nozzle 10 adopting the air blast method can be produced easily and inexpensively.

Embodiment 2

Figure 2:
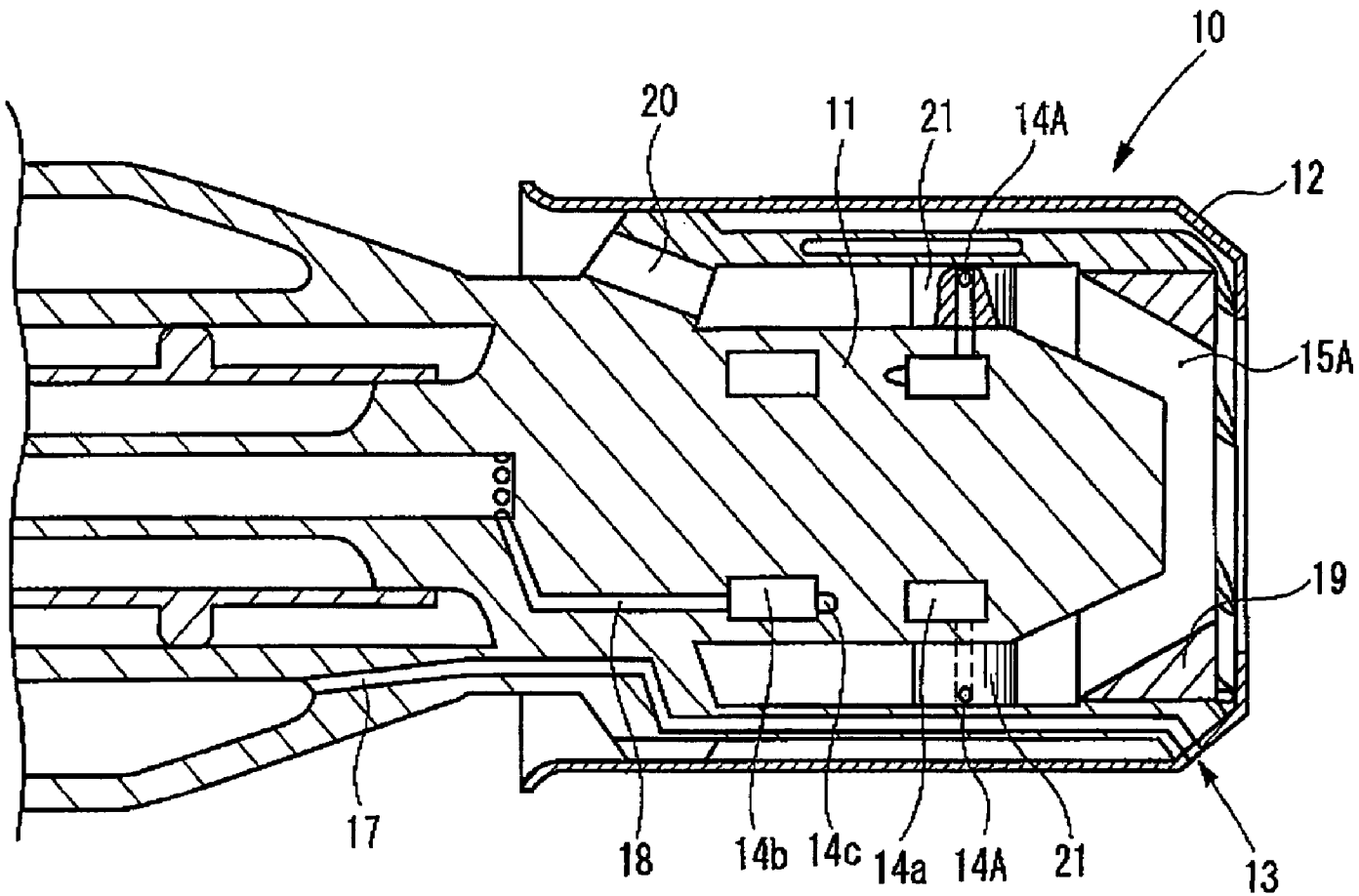
FIG. 2 is a sectional view of essential parts of a pilot nozzle, showing Embodiment 2 of the present invention.

FIG. 2 is a sectional view of essential parts of a pilot nozzle, showing Embodiment 2 of the present invention.

The present embodiment is an embodiment in which the first air blast nozzle portion 15*a* in Embodiment 1 is abolished; only an annular air blast nozzle portion 15A corresponding to the second air blast nozzle portion 15*b* in Embodiment 1 is provided; and the front end of a liquid nozzle portion 14A formed in the shape of a port and communicating with the annular front-stage liquid nozzle portion 14*a* is open to each of vane-shaped swirlers 21 provided in the air blast nozzle portion 15A. Since other features are the same as those in Embodiment 1, the same members as those shown in FIG. 1 are assigned the same numerals as in FIG. 1, and duplicate explanations are omitted.

According to the present embodiment, the liquid fuel injected from the liquid nozzle portions 14A forms a liquid film spreading along the outer circumferential wall surface of the air blast nozzle portion 15A, and an air blast by the air blast nozzle portion 15A is produced inside this liquid film, thereby promoting the atomization of the liquid fuel.

Thus, the same actions and effects as those in Embodiment 1 are obtained. Furthermore, the first air blast nozzle portion 15*a* in Embodiment 1 is abolished. This brings the advantage that the passage and nozzle structures in the nozzle body 11 can be simplified as compared with Embodiment 1.

Embodiment 3

Figure 3:
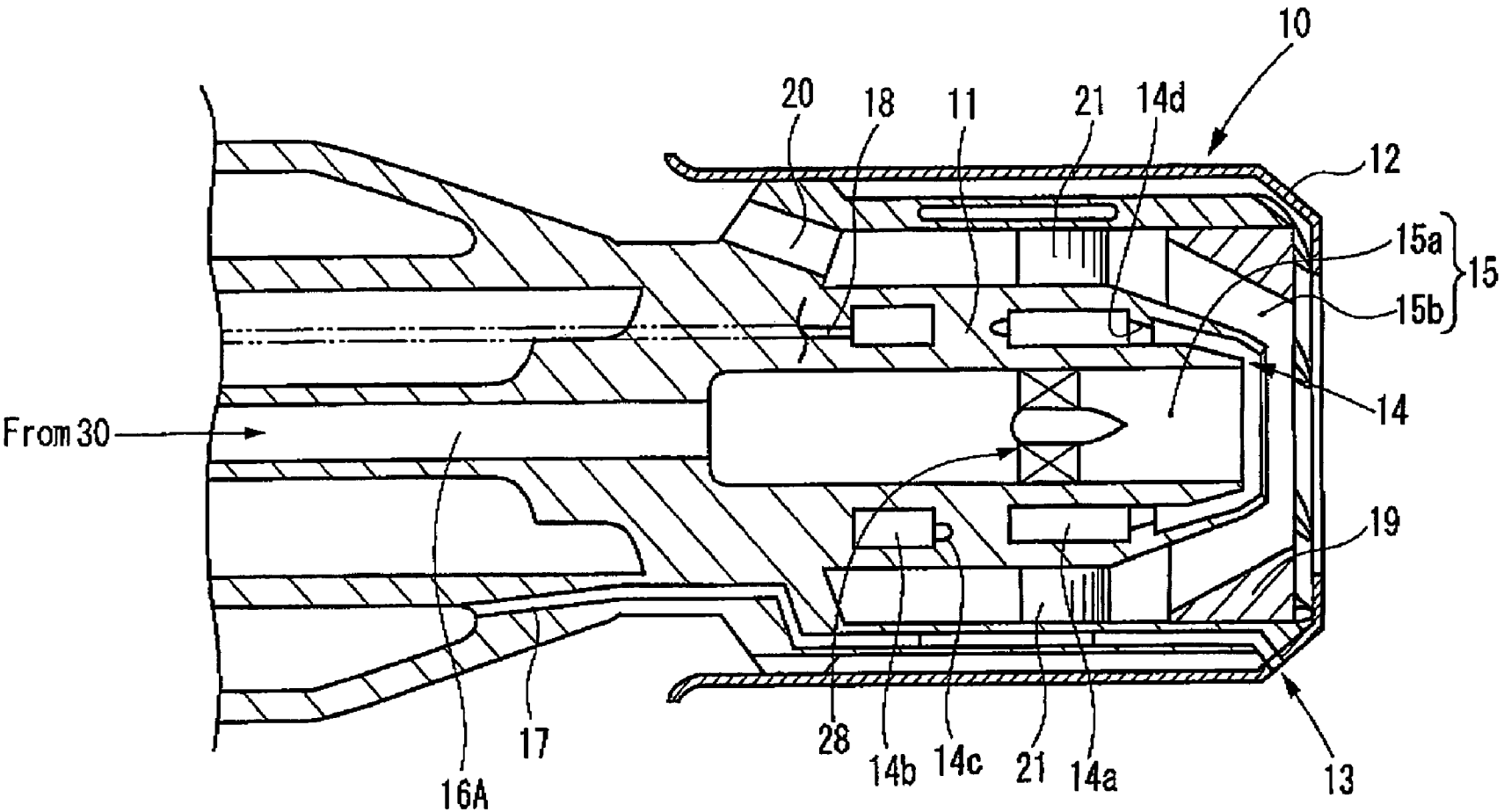
FIG. 3 is a sectional view of essential parts of a pilot nozzle, showing Embodiment 3 of the present invention.

FIG. 3 is a sectional view of essential parts of a pilot nozzle, showing Embodiment 3 of the present invention.

The present embodiment is an embodiment in which the air passage 16 for supplying pressurized air to the first air blast nozzle portion 15*a* in Embodiment 1 is formed as a single air passage 16A penetrating the center of the nozzle body 11, and external piping is connected to the air passage 16A so that pressurized air within the turbine casing is supplied to the first air blast nozzle portion 15*a* (see a pressurized air outlet 30 formed in the turbine casing 180 of FIG. 4 and having external piping connected thereto). Also, a swirler 28 is mounted inside the first air blast nozzle portion 15. Since other features are the same as those in Embodiment 1, the same members as those shown in FIG. 1 are assigned the same numerals as in FIG. 1, and duplicate explanations are omitted.

According to the present embodiment, the liquid fuel injected from the liquid nozzle portion 14 is atomized to a higher degree by air blasts generated in a sandwich form. Thus, the same actions and effects as those in Embodiment 1 are obtained. Furthermore, the single air passage 16A offers the advantage that the passage structure in the nozzle body 11 can be simplified as compared with Embodiment 1.

It goes without saying that the present invention is not limited to the foregoing embodiments, but various changes and modifications, such as a change in the structure of the swirler and a change in the shape of the nozzle portion, can be made without deviating from the subject matter of the present invention.

What is claimed is:

1. A gas turbine combustor in a gas turbine furnished with a dual fuel combustion low $NO_x$ combustor having a pilot nozzle capable of injecting a gaseous fuel and a liquid fuel simultaneously or selectively, and a plurality of main nozzles disposed around the pilot nozzle and being capable of injecting a gaseous fuel and a liquid fuel simultaneously or selectively, wherein the pilot nozzle has a gas nozzle portion for injecting the gaseous fuel, and a liquid nozzle portion for injecting the liquid fuel, adopts an air blast method for the liquid nozzle portion, uses combustion air as air for an air blast, and throws the combustion air at a liquid film formed in the liquid nozzle portion to atomize the liquid fuel by use of a velocity difference between the combustion air and the liquid film, wherein the liquid nozzle portion is formed in an annular shape in order to inject the liquid fuel in an annular liquid film state, and further has a first air blast nozzle portion for producing an air blast along an inner surface of a film of the liquid fuel injected in the annular liquid film state, and a second air blast nozzle portion for producing an air blast along an outer surface of the film of the liquid fuel, and wherein the first air blast nozzle portion is provided at a center of the pilot nozzle, and the combustion air within a turbine casing is supplied to the first air blast nozzle portion via external piping through an air passage penetrating a center of the pilot nozzle.

2. The gas turbine combustor according to claim 1, wherein the second air blast nozzle portion is formed in an annular shape for producing the air blast in an annular form.

3. The gas turbine combustor according to claim 2, wherein the second air blast nozzle portion has a swirler disposed in an interior thereof.

4. The gas turbine combustor according to claim 1, wherein the first air blast nozzle portion has a swirler disposed in an interior thereof.

* * * * *